US006220576B1

(12) United States Patent
Chan

(10) Patent No.: US 6,220,576 B1
(45) Date of Patent: Apr. 24, 2001

(54) FLEXIBLE ROAD SAFETY-GUARD

(76) Inventor: Raymond Chi Lap Chan, Cornell Centre, 50 Wing Tai Road, Chai Wan (HK)

( * ) Notice: Subject to any disclaimer, the term of this patent is extended or adjusted under 35 U.S.C. 154(b) by 0 days.

(21) Appl. No.: 09/282,487

(22) Filed: Mar. 31, 1999

(30) Foreign Application Priority Data

Dec. 25, 1998 (CH) ..... 98247770

(51) Int. Cl.[7] ..... E01F 15/02
(52) U.S. Cl. ..... 256/13.1; 404/6
(58) Field of Search ..... 256/13.1–19; 404/6, 404/9, 10, 8

(56) References Cited

U.S. PATENT DOCUMENTS 2,047,436 * 7/1936 Shepherd ..... 256/13.1
3,704,861 * 12/1972 Glaesener ..... 256/13.1
3,963,218 * 6/1976 Glaesener ..... 256/13.1
4,000,882 * 1/1977 Penton ..... 256/13.1
4,146,113 * 3/1979 Gavel ..... 256/13.1 X
4,723,758 * 2/1988 Gehrig ..... 256/13.1
5,195,727 * 3/1993 Liao et al. ..... 256/13.1
5,203,543 * 4/1993 Fleury ..... 256/13.1
5,284,326 * 2/1994 Chiovitti et al. ..... 256/13.1
5,429,449 * 7/1995 Baatz ..... 256/13.1 X
6,007,269 * 12/1999 Marinelli ..... 256/13.1 X

* cited by examiner

*Primary Examiner*—Harry C. Kim
(74) *Attorney, Agent, or Firm*—Ladas & Parry

(57) ABSTRACT

A flexible road safety-guard is provided. The road safety-guard has a base 1, an upright column 2, a safety-guard 3 and connectors. The base 1 is positioned at the lower end of the upright column 2 forming an integrated whole therewith. Mounting holes are provided in the safety-guard. Each of the upright column, the base and the safety-guard is made of Rotational Grade Polyethylene material by slush molding and has hollow structure. Male and female die block interfaces are formed respectively at each end of the safety-guard along its length, that is, one end is an insert interface having smaller outer profile and the other end is a mating interface which engages with the insert interface. The safety-guard 3 has a cross-sectional shape which is substantially flat on one side and contoured on an opposite side, the contoured side having vertically spaced arcuate portions interconnected by a flattened portion. The present utility invention is extremely flexible, so that in the event of a vehicle crash it has extremely high shock absorption to eliminate to the utmost energy generated by the shock. Meanwhile, it can greatly reduce the damage to the vehicle as well as the injuries or deaths. Generally it needs no maintenance and is economical and durable.

3 Claims, 3 Drawing Sheets

FLEXIBLE ROAD SAFETY-GUARD

The present utility invention relates to a road safety-guard, particularly, to a flexible road safety-guard having excellent anti-impact properties.

In the prior art, there are many types of road safety-guards, and two factors considered normally are to make disassemble and assemble operations easier and make the safety-guards have better anti-shock properties, as shown in Chinese Utility Model 92192135.6, entitled *"A removable erection device for safety-guards"*. This utility model is designed to improve the damping effect of the erection device of the conventional vehicle safety-guards and facilitate both assemble and disassemble operations. In this utility model, a hollow cushion block is used instead of the solid cushion block, thus absorbing vibrations; and the members are attached to each other in a removable manner, so as to shorten the assembling time. However, disadvantages still remain in the above-said utility model as all the members of the safety-guard are made of metallic materials having higher strength and hardness or cement, etc.; though the hollow cushion block is used to absorb vibrations, the damping effect is very limited; when subject to an impact from vehicle, the safety-guard will deform and be damaged thereby inevitably, and vice versa, the counteractive impact on the vehicle will also cause serious damages to the vehicle and the injuries or deaths. The damaged road safety-guards need replacement with new members and repairing. Even if the crash is not too serious, the safety-guard will deform certainly, so frequent maintenance is needed.

An object of the present utility invention is to provide a flexible road safety-guard which can reduce the damage thereto after being crashed.

The object of the present utility invention can be realized by the following technical measures. The flexible road safety-guard comprises a base, an upright column, a safety-guard and connectors, wherein the base is positioned at the lower end of the upright column forming an integrated whole therewith, and mounting holes are provided in the safety-guard, characterized in that: each of the upright column, the base and the safety-guard is made of Rotational Grade Polyethylene material by slush moulding and has hollow structure; a male and a female die block interfaces are provided respectively at each end of the safety-guard along its length, that is, one end is an insert interface having smaller outer profile and other end is a mating interface which engages with the insert interface, so that many pieces of safety-guards can be connected end to end to form a safety-guard as long as desired.

The cross section of the safety-guard according to the present utility invention can be of "B" shape, so as to improve the strength and toughness of the safety-guard.

The connectors according to the present utility invention further include a hollow cushion block and connecting bolts, wherein the front end surface of the cushion block is plane, engaging with the back side of the safety-guard; and the back end surface of its is coincide with the shape of the cross section of the upright column to facilitate the engagement between these two members. The cushion block can enlarge the usage range of the shape of the upright column; no matter whether the upright column is cylindrical, square or polygonal in shape, all can be used; additionally, the cushion block can also improve the anti-shock properties of the present utility.

The present utility invention has following advantages compared with the prior art:

(1) Extremely high shock absorption and flexibility. Due to the use of Rotational Grade Polyethylene material and the hollow structure, the present utility model has extremely high flexibility so that in case of vehicle crash, not only the safety-guard but also the upright column will deform as a spring, absorbing shock to the utmost extent, thus eliminating the enormous energy generated by the shock. Especially when the connectors are hollow cushion block, the effect is remarkable. Moreover, the inherent properties of the material make itself so flexible like a sponge that the reactive force to the vehicle is minimized, greatly reducing the damage to the vehicle as well as the injuries or deaths. If the mounting hole on one of the engaging interfaces of the safety-guard are formed into a rectangular shape, the safety-guard will more easily tend to deform elastically, thereby further improving shock absorption.

(2) When the safety-guard of the present utility invention crashed, the damaged thereto is very limited due to its flexibility; and if the crash is not too serious, it can recover after the removal of the external force, and need not renovation.

(3) The safety-guard of the present utility invention needs low costs and no maintenance, and is also sun- and rain-proof, so the construction and maintenance costs of the road safety-guard can be reduced and the safety-guard is economical and durable.

(4) The present utility invention is available in a large choice of colors, thus being advantageous to improving the environment along the road.

The present utility invention will now be described in detail with reference to the accompanying drawings, in which.

Figure 1:
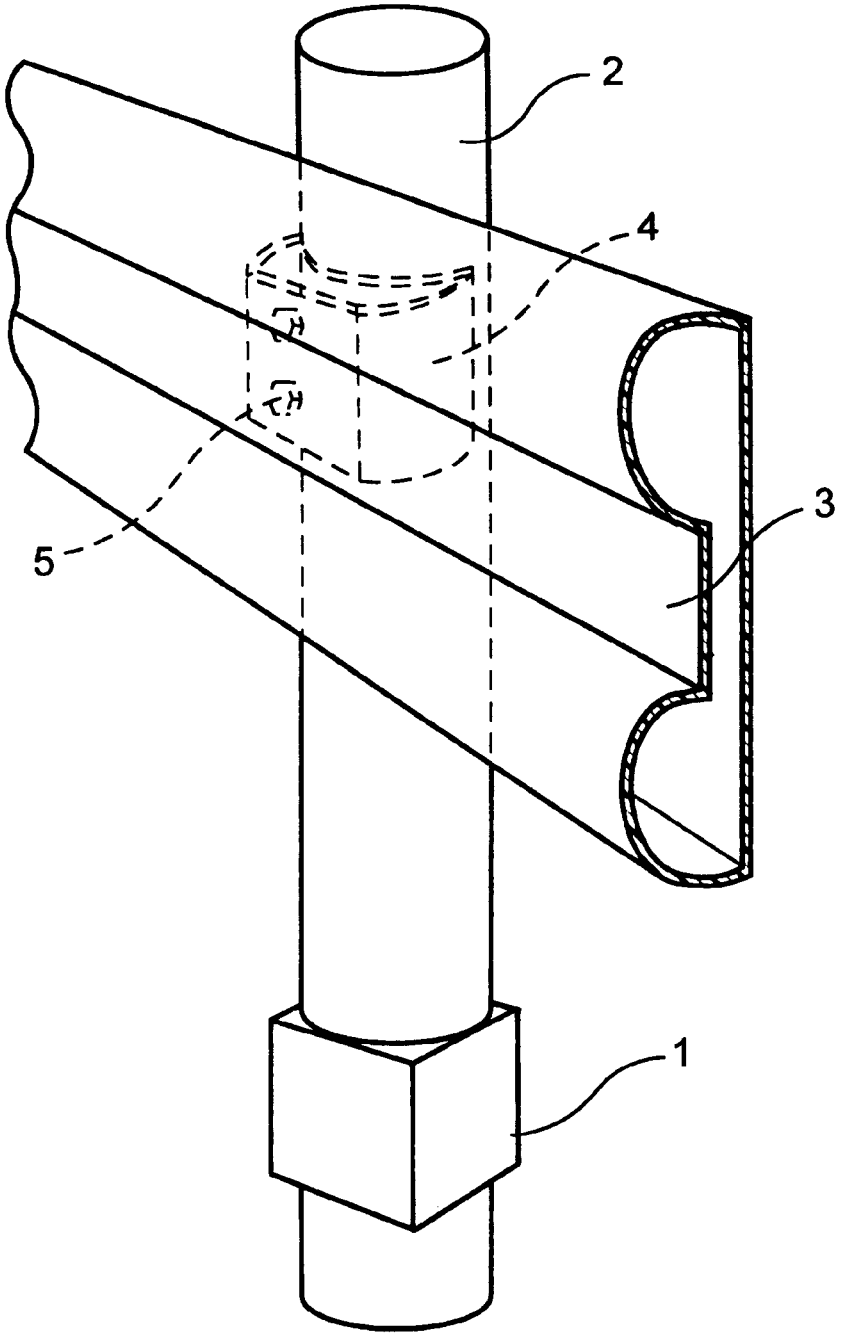
FIG. 1 is a perspective view of an embodiment of the present utility invention.
Figure 2:
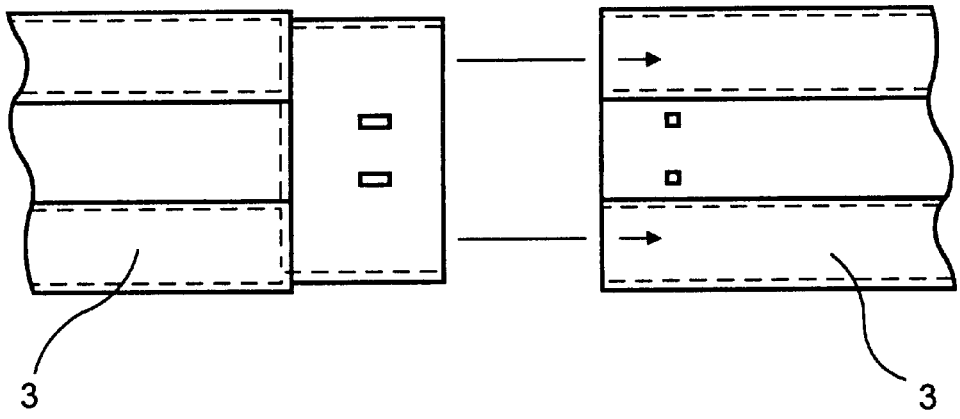
FIG. 2 is an elevation view of the interface of the safety-guard of the present utility invention.
Figure 3:
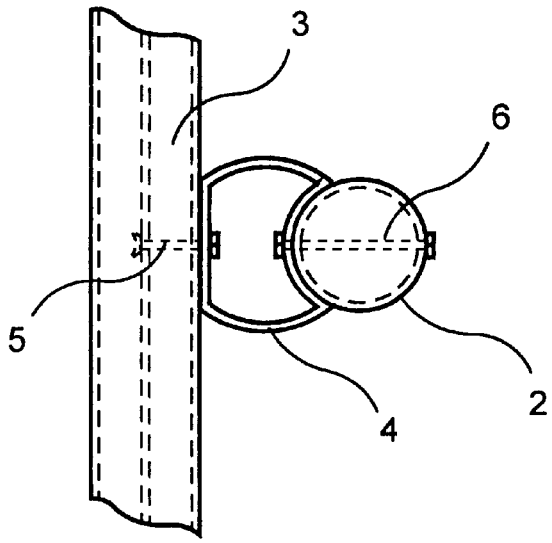
FIG. 3 is a top view of the present utility invention in FIG. 1.
Figure 4:
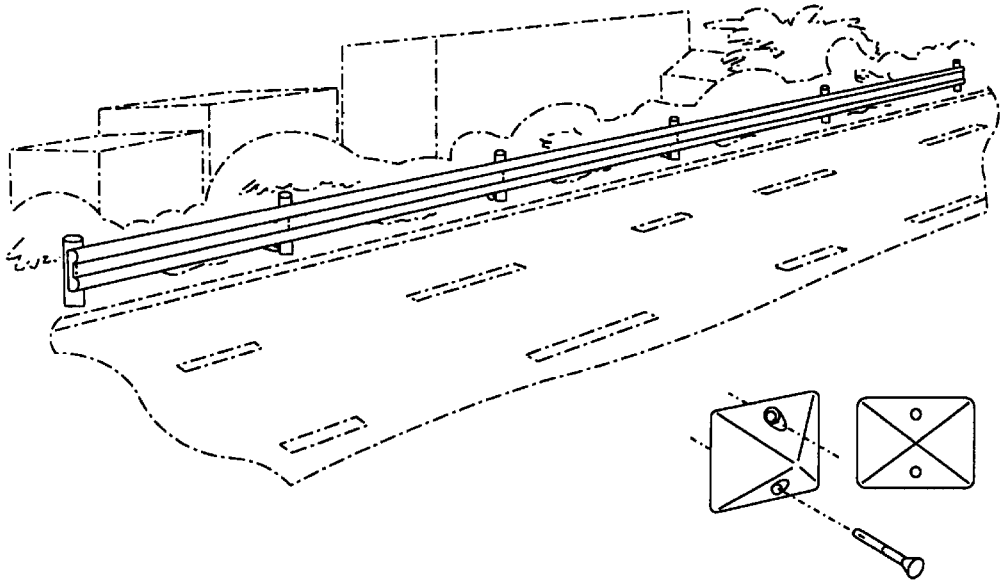
FIG. 4 is a view illustrating the operation condition of an embodiment of the present utility invention.

Shown in FIG. 1 to FIG. 4 is an embodiment of the flexible road safety-guard according to the present utility invention, which comprises a base 1, an upright column 2, a safety-guard 3 and connectors, wherein the base 1 is positioned at the lower end of the upright column 2 forming an integrated whole therewith; the base 1 is embedded in ground in order to secure the upright column 2; mounting holes are provided on the safety-guard; each of the upright column, the base and the safety-guard is slush-moulded of Rotational Grade Polyethylene material and has hollow structure. A male and a female die block interfaces are provided respectively at each end of the safety-guard along its length, that is, one end is an insert interface having smaller outer profile and the other end is a matting interface which engages with the insert interface, the mounting holes in the insert interface are in the shape of rectangle, thereby benefiting the engagement; more important is that the safety-guard is permitted more freely to deform elastically when subject to an impact. In this manner, when the safety-guard is secured on the upright column, the interfaces of two pieces of safety-guards can also be secured together. Many pieces of safety-guards can be connected end to end, so as to form a safety-guard as long as desired. The cross section of said safety-guard is of "B" shape, which can help improving the strength and toughness thereof. Said connectors include hollow cushion block 4 and self-lock connecting bolts 5 and 6. The front end surface of the cushion block is plane, which engages with the backside of the safety-guard, and the connecting bolt 5 connects these two engaging surfaces and secures them together. The shape of the back end surface of the cushion block corresponds with the round cross section of the upright column; the connecting bolt 6 penetrates the upright column to secure the back end surface of the cushion block thereon. Other road facilities, such as reflecting road signs, can also be mounted on the safety-guard.

Figure 5:
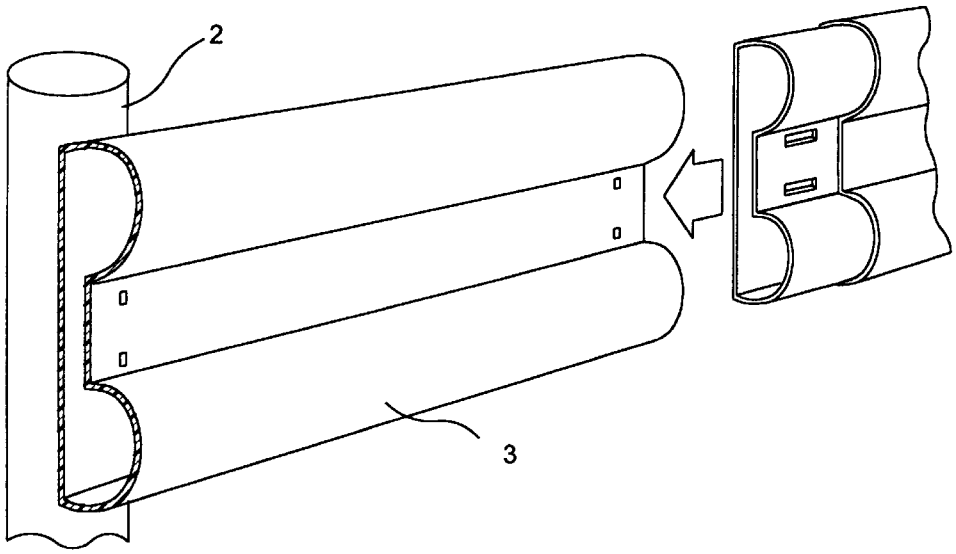
FIG. 5 is a perspective view of another embodiment of the present utility invention.

The flexible road safety-guard shown in FIG. 5 being another embodiment of the present utility invention comprises a base 1, an upright column 2, a safety-guard 3 and connectors, which is different from the connectors of the former embodiment in that said connectors include only self-lock bolt 5 penetrating the upright column, through which the safety-guard 3 is mounted directly onto the upright column 2.

What is claimed is:

1. A flexible road safety-guard, comprising a base (1), an upright column (2), a safety-guard (3) and connectors, wherein the base (1) is positioned at the lower end of the upright column (2) forming an integrated whole therewith, and mounting holes are provided in the safety-guard (3), wherein each of the upright column, the base and the safety-guard is made of Rotational Grade Polyethylene material by slush molding and each has a hollow structure; male and female die block interfaces are provided respectively at each end of the safety-guard (3) along its length, one end being an insert interface having a smaller outer profile and the other end being a mating interface which engages with the insert interface; and wherein the safety-guard (3) has a cross-sectional shape which is substantially flat on one side and contoured on an opposite side, the contoured side having vertically spaced arcuate portions interconnected by a flattened portion.

2. A flexible road safety-guard according to claim 1, wherein said connectors further include a hollow cushion block (4) and connecting bolts, wherein a front end surface of the cushion block (4) is plane, and a back end surface of said cushion block (4) is shaped to correspond to the shape of a cross section of the upright column (2), so that the upright column and the back end surface of the cushion block can engage each other.

3. A flexible road safety-guard according to claim 2, wherein said connecting bolts (5,6) are self-locking; the front end surface of said cushion block is plane, engaging with the back side of the safety-guard; the connecting bolt (5) connects these two engaging surfaces and secures them together; the back end surface of said cushion blcok corresponds with the shape of a round cross section of the upright column (2); and the connecting bolt (6) penetrates the upright column to secure the back end surface of the cushion block thereon.

* * * * *

UNITED STATES PATENT AND TRADEMARK OFFICE

CERTIFICATE OF CORRECTION

PATENT NO. : 6,220,576 B1
DATED : April 24, 2001
INVENTOR(S) : Raymond Chi Lap Chan It is certified that error appears in the above-identified patent and that said Letters Patent is hereby corrected as shown below:

Title page,
Item [30], "CH" should read -- CN --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*